US011793293B2

(12) United States Patent
Bickford

(10) Patent No.: US 11,793,293 B2
(45) Date of Patent: Oct. 24, 2023

(54) REFILLABLE COSMETIC CONTAINER

(71) Applicant: L'OREAL, Paris (FR)

(72) Inventor: William Bickford, Scotch Plains, NJ (US)

(73) Assignee: L'Oreal, Paris (FR)

( * ) Notice: Subject to any disclaimer, the term of this patent is extended or adjusted under 35 U.S.C. 154(b) by 251 days.

(21) Appl. No.: 16/887,954

(22) Filed: May 29, 2020

(65) Prior Publication Data

US 2021/0368964 A1 Dec. 2, 2021

(51) Int. Cl.
*A45D 40/00* (2006.01)
*A45D 40/22* (2006.01)

(52) U.S. Cl.
CPC ..... *A45D 40/0068* (2013.01); *A45D 40/221* (2013.01); *A45D 2200/05* (2013.01)

(58) Field of Classification Search
CPC .. B65D 3/22; B65D 43/0231; B65D 25/2835; B65D 77/0486; A45D 2200/05; A45D 40/221; A45D 40/0068; A45D 40/265; A45D 40/0075; A45D 40/16
USPC ..... 206/581; 220/23.87, 23.91, 23.89
See application file for complete search history.

(56) References Cited

U.S. PATENT DOCUMENTS 933,444 A * 9/1909 Henki ..... B65D 1/265 206/219
2,076,549 A 4/1937 Conner
2,077,215 A 4/1937 Conner
4,379,578 A 4/1983 Schuler
5,078,287 A * 1/1992 Holmes, III ..... A61J 9/00 215/11.1

(Continued)

FOREIGN PATENT DOCUMENTS

EP 0661012 A1 7/1995
EP 2308339 A1 4/2011

(Continued)

OTHER PUBLICATIONS

Preliminary Search Report, dated Feb. 12, 2021, issued in corresponding French Application No. 2007359, 2 pages.

(Continued)

*Primary Examiner* — Chun Hoi Cheung
(74) *Attorney, Agent, or Firm* — Christensen O'Connor Johnson Kindness PLLC

(57) ABSTRACT

A refillable cosmetic container system comprising an outer container that can be closed by an optional lid, and an inner cosmetic holding canister that can be removably mounted within the container. A coupling system can be implemented to allow the outer container and the inner canister to be selectively coupled to each other, such as a lug-and-groove interface, latch and catch interface, etc. The coupling system may be configured such that rotation of the inner canister relative to the outer container causes the coupling/decoupling (e.g., locking/unlocking) between the outer container and the inner canister. To aid in selective coupling (e.g., coupling and decoupling) of the inner canister with respect to the outer container, a handle is provided on the inner container. A locking feature may be provided between the handle and the outer container ensures that the inner canister does not prematurely or unnecessarily dislodge from the outer container.

13 Claims, 7 Drawing Sheets

(56) References Cited

U.S. PATENT DOCUMENTS

| | | | | |
|---|---|---|---|---|
| 5,356,025 | A * | 10/1994 | Renault | A45D 40/22 220/837 |
| 6,923,347 | B2 * | 8/2005 | Winckels | A45D 40/0068 222/206 |
| 6,945,419 | B2 * | 9/2005 | Bertazza | A45D 40/265 220/23.91 |
| 7,621,411 | B2 * | 11/2009 | Doherty | B65D 50/041 215/277 |
| 8,479,940 | B2 * | 7/2013 | Marra | B65D 23/0885 220/23.89 |
| 9,370,233 | B2 * | 6/2016 | Jung | B05B 11/3026 |
| 2005/0258126 | A1 | 11/2005 | Canamasas Puigbo | |
| 2006/0043109 | A1 * | 3/2006 | Masuda | B65D 83/0055 222/105 |
| 2011/0272410 | A1 * | 11/2011 | Sato | B05B 11/0054 220/500 |
| 2013/0075287 | A1 * | 3/2013 | Sharon | G06Q 30/02 206/219 |
| 2020/0071047 | A1 * | 3/2020 | Chen | B65D 77/0493 |

FOREIGN PATENT DOCUMENTS

| | | | | |
|---|---|---|---|---|
| FR | 2741042 | A1 | 5/1997 | |
| JP | S6346331 | U | 3/1988 | |
| JP | 2015030459 | A | 2/2015 | |
| WO | WO-2006008147 | A2 * | 1/2006 | A47G 19/065 |
| WO | 2018/202385 | A1 | 11/2018 | |

OTHER PUBLICATIONS

Written Opinion, dated Feb. 12, 2021, issued in corresponding French Application No. 2007359, 4 pages.

* cited by examiner

REFILLABLE COSMETIC CONTAINER

SUMMARY

Embodiments of the present disclosure relate to, among other things, refillable cosmetic container systems. In an embodiment, a method of replacing a cosmetic formula in a reusable container is also described.

In accordance with an aspect of the present disclosure, a refillable cosmetic container system is provided. In an embodiment, the system comprises an outer container with an outer wall defining an inner chamber with a first opening proximate a top of the outer container and a second opening proximate a bottom of the container, an inner canister supported within the inner chamber of the outer container, and a handle proximate a bottom end of the inner canister, the handle configured to pass through the second opening of the outer container. In an embodiment, the handle is configured to lock the inner canister to the outer container.

In accordance with another aspect of the present disclosure, a method is provided for replacing a cosmetic formula in a reusable container. In an embodiment, the method comprises inserting an inner canister into an inner chamber of the reusable container, the inner canister having a handle movable between an extended position and a retracted position, applying a rotational force to the handle in the extended position to move the inner canister to a locked position; and moving the handle to the retracted position so that a first locking feature of the handle engages a second locking feature of the outer container. In an embodiment, the first and second locking feature prohibits rotation of the inner canister with respect to the reusable container.

In accordance with any embodiment, a torque applied to the handle locks the inner canister to the outer container.

In accordance with any embodiment, the inner canister is rotationally supported by the outer container, and wherein a rotational force can be applied to the handle to rotate the inner canister with respect to the outer container.

In accordance with any embodiment, a torque applied to the handle allows for coupling of the inner canister to the outer container.

In accordance with any embodiment, the handle is hingedly coupled to the inner canister.

In accordance with any embodiment, the handle is moved about a hinge from a first position in which the handle is configured to pass through the second opening of the outer container and a second position in which the handle is stowed adjacent a bottom wall of the inner canister.

In accordance with any embodiment, a living hinge is provided. The living hinge couples the handle to the inner canister.

In accordance with any embodiment, the outer container is reusable and the inner canister is replaceable.

In accordance with any embodiment, the outer container is reusable.

In accordance with any embodiment, the inner canister contains a cosmetic formula.

In accordance with any embodiment, a lid is provided that is coupleable to the outer container.

In accordance with any embodiment, a locking system is provided. The locking system is configured to couple the handle of the inner canister to the outer container.

In accordance with any embodiment, the locking system comprises a first locking feature disposed on the handle, and a second locking feature disposed on the outer container, wherein the first locking features engages the second locking feature.

In accordance with any embodiment, the first and second locking features are substantially aligned when the inner canister is in the locked position.

In accordance with any embodiment, the handle is moved into an extended position before the step of applying a rotational force to a handle.

In accordance with any embodiment, the handle is moved into the extended position, a rotational force is applied to the extended handle to move the inner canister to an unlocked position, and the inner canister removed from the reusable container.

In accordance with any embodiment, the handle is moved into the extended position by disengaging the first locking feature of the handle from the second locking feature of the outer container.

In accordance with any embodiment, the handle is moved to the retracted position by folding the handle about a hinge.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Using a refillable cosmetic container may reduce waste and enable the user to save cost on expensive or elaborate packaging. The reusable container may be customizable to each specific user which may enable the user to invest in a quality packaging system without having to continuously replace it.

Examples of the present disclosure provides a refillable cosmetic container system comprising an outer packaging body or container that can be closed by a lid, and an inner cosmetic holding jar or canister that can be removably mounted within the container. Different mating or coupling systems can be implemented to allow the outer container and the inner canister to be selectively coupled to each other, such as a lug-and-groove interface, latch and catch interface, etc. Such mating or coupling systems can also be referred to as locking systems.

In some embodiments of the present disclosure, the coupling system is configured such that rotation of the inner canister relative to the outer container causes the coupling/decoupling (e.g., locking/unlocking) between the outer container and the inner canister. To aid in selective coupling (e.g., coupling and decoupling) of the inner canister with respect to the outer container, a handle is provided on the inner container.

As will be described in more detail below, the handle is formed, for example, as a folding handle, which can be positioned at the bottom of the inner canister in some embodiments. In use, the handle extends outwardly to an extended position to better permit a user to grip and rotate the inner canister relative to the outer container. As will be further described in more detail below, a locking feature between the handle and the outer container ensures that the inner canister 104 does not prematurely or unnecessarily dislodge from the outer container 102.

The following description provides several examples of the refillable cosmetic system that may be used with a wide variety of cosmetic formulas, including eye shadow, blush, foundation, concealer, bronzer, highlighter, lip gloss, lotion, creams, serum, hair products, cleansers, ointment, salves or balms etc. In some instances, the refillable cosmetic system may have multiple components. In some embodiments, one or more of the components may be reusable. For example, in some embodiments the outer container is reusable to avoid waste, etc. In other embodiments, both the outer container and the inner canister is reusable. In some embodiments, one or more of the components may be replaceable. For example, the inner canister may be removed from the cosmetic system and recycled or disposed and replaced with a new inner container containing a new or refreshed cosmetic formula.

Figure 1:
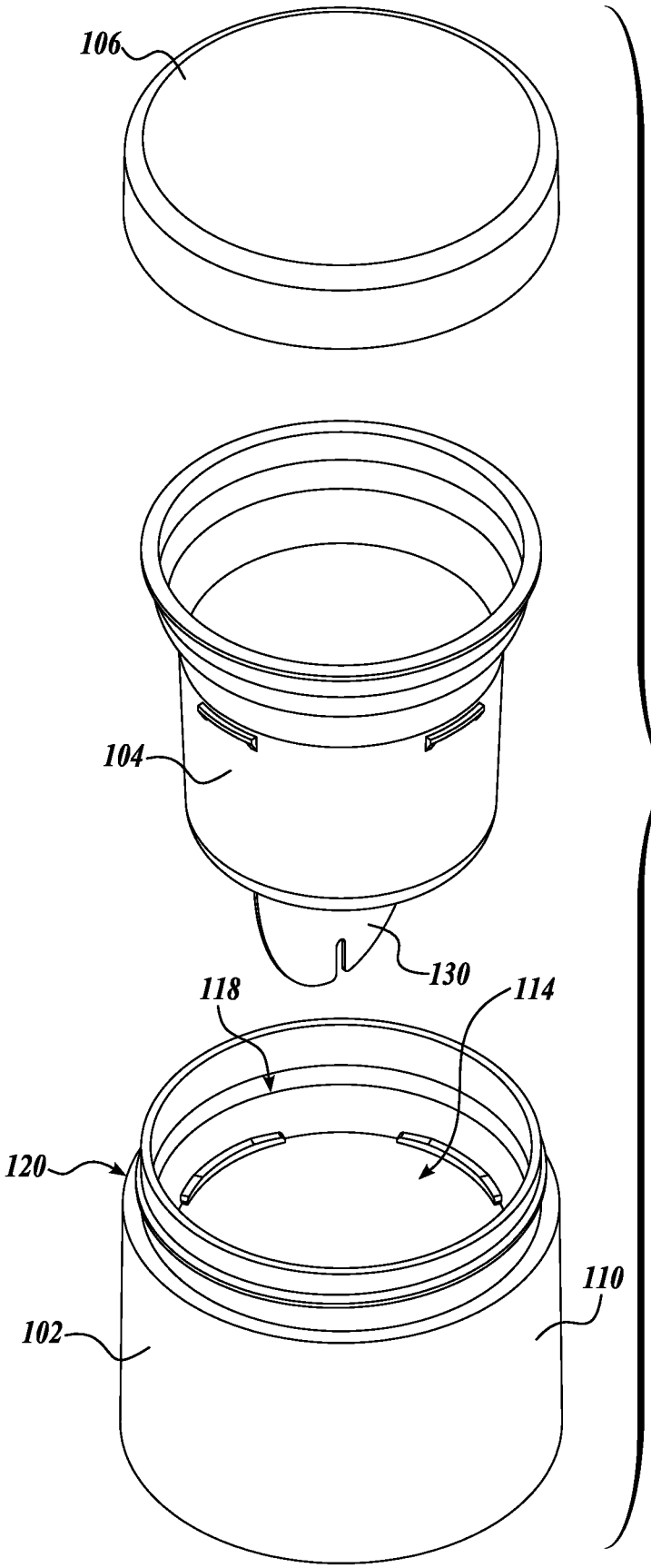
FIG. 1 is an exploded view of a representative refillable cosmetic system according to an aspect of the present disclosure.

FIG. 1 depicts an exploded view of one embodiment of a refillable cosmetic system 100. As shown in FIG. 1, the system 100 includes an outer packaging body or container 102, an inner container or canister 104, and an optional lid 106. In the embodiment shown, the inner canister 104 is configured to contain a cosmetic formula, examples of which were described briefly above.

In use, the refillable cosmetic system 100 enables a user to replace the cosmetic formula used by a subject. For example, the cosmetic formula may be replaced either when a user consumes the product or desires to switch products. In some embodiments, the cosmetic formula can be replaced as desired or as needed by either replacing the canister with a new cosmetic formula filled canister or refilling the old canister with new cosmetic formula. To reduce waste, the outer container 102 may be reusable in some embodiments.

Figure 2:
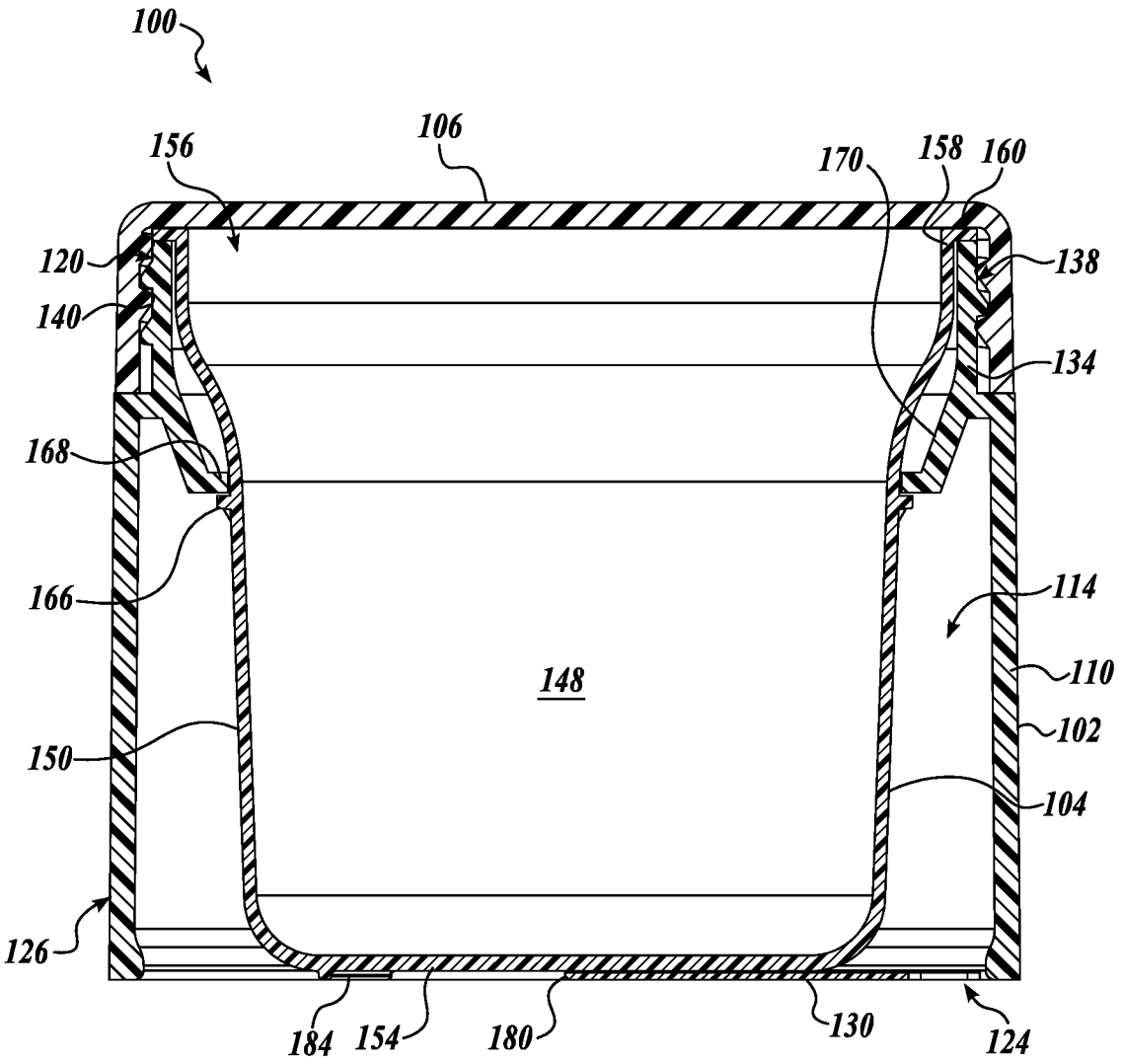
FIG. 2 is a cross-sectional view of the refillable cosmetic system of FIG. 1, depicting a handle in the retracted position.

As shown in FIGS. 1 and 2, the outer container 102 is generally configured as a hollow, open-ended structure or housing configured to removably receive the inner canister 104. In the depicted embodiment, the outer container 102 may have an outer cylindrical wall 110 defining an inner chamber 114 with a first or top opening 118 proximate a top end 120 and a second or bottom opening 124 proximate a bottom end 126 of the container 102. As shown, the inner chamber 118 in some embodiments may be substantially cylindrical in part or as a whole.

The lid 106 covers the top opening 118 of the outer container 102 to, for example, preserve the cosmetic formula. In the embodiment shown, the lid 106 is removably attached to an upper portion of the container 102. For example, the lid 106 may be removably attached to the container 102 via a threaded connection, a snap fit, a press fit, etc.

As will be described in more detail below, the inner canister 104 interfaces with the outer container 102 in a selectively coupled or locking manner. For example, with the lid removed, a coupling system may be formed between the outer container 102 and the inner canister 104 to allow selective coupling or locking between the inner canister 104 and the outer container 102. In some embodiments, the coupling system is configured so that when the inner canister 104 is in a first, coupled or locked position, the inner canister 102 is prevented from being removed from the outer container 102 via its top opening 118, and when the inner canister 104 is a second, decoupled or unlocked position, the inner canister 104 is permitted to be removed from the outer container 102 via its top opening 118.

In an embodiment, to move the inner canister 104 between the coupled position and the decoupled position, the inner canister 104 is rotated about its central (e.g., longitudinal) axis with respect to the outer container 102. As will be described in more detail below, to aid in rotation of the inner canister 104 with respects to the outer container 102 between the coupled and decoupled positions, a grip or handle 130 is provided.

Turning now to FIGS. 2-5, the components of the refillable cosmetic system 100 will be described in more detail. In the embodiment shown, the cylindrical wall 110 of the outer container 102 may include an inwardly extending, stepped portion 134 proximate the top end 120 of the outer container 102. The stepped portion 134 may receive a correspondingly-shaped lid 106 when the lid 106 is coupled to the top end 120 of the outer container 102. In some embodiments, the lid 106 and the stepped portion 134 are sized and configured such that the side walls of the lid 106 are substantially flush with the outer walls 110 of the outer container 102. The stepped portion 134 may include a series of threads, snap-fit features, press-fit features, etc., that mate with corresponding features on the interior of the lid 106. In the embodiment shown, cooperating threads 138 and 140 are shown.

Figure 4A:
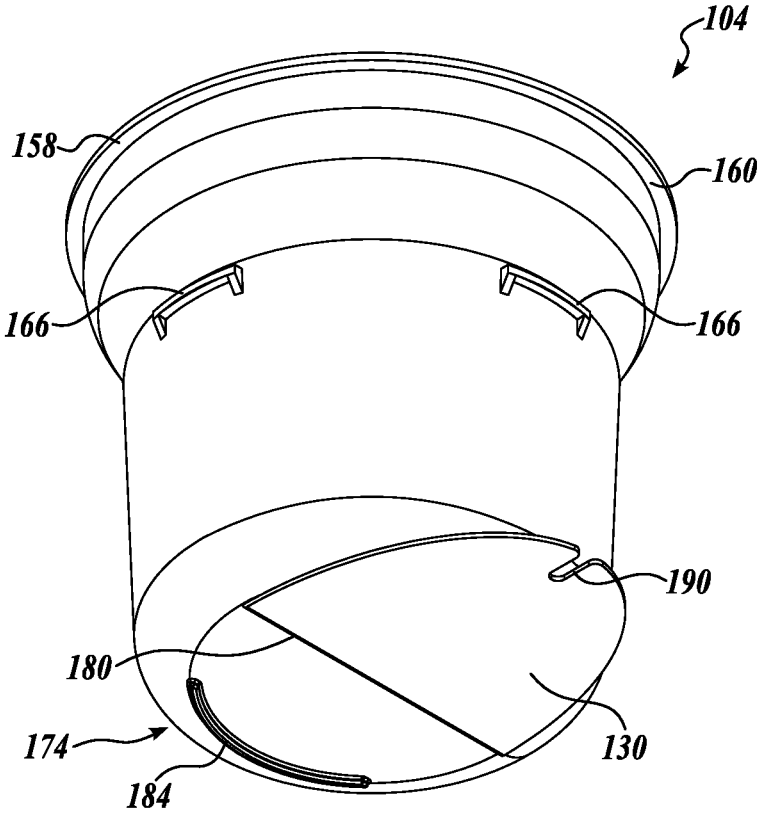
FIG. 4A is a bottom perspective view of a canister of the representative refillable cosmetic system of FIG. 1.
Figure 4B:
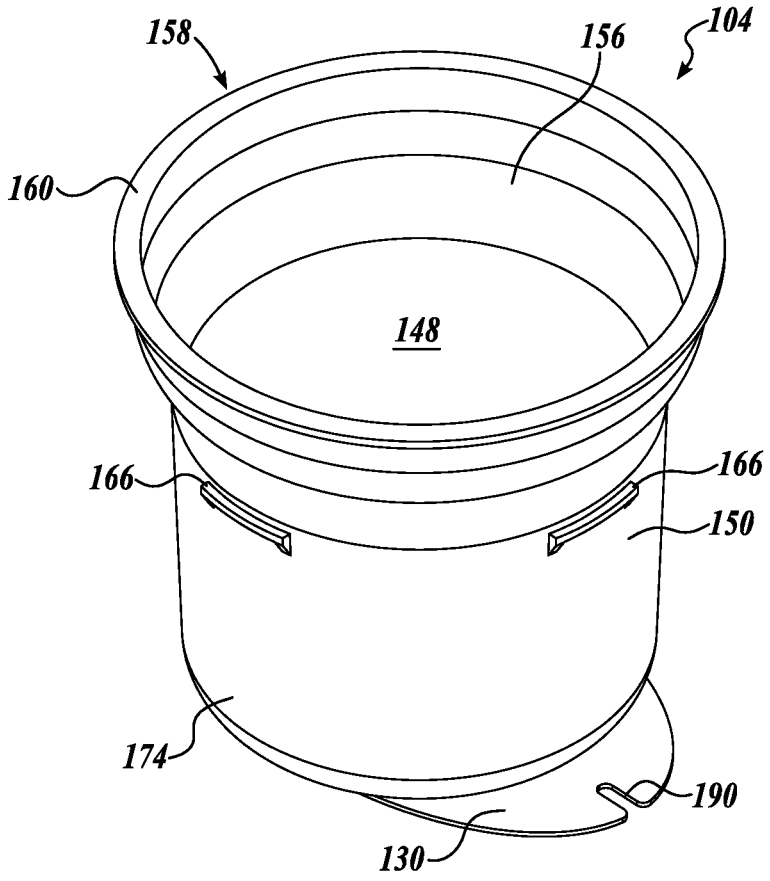
FIG. 4B is a bottom perspective view of the canister of FIG. 4A.
Figure 5:
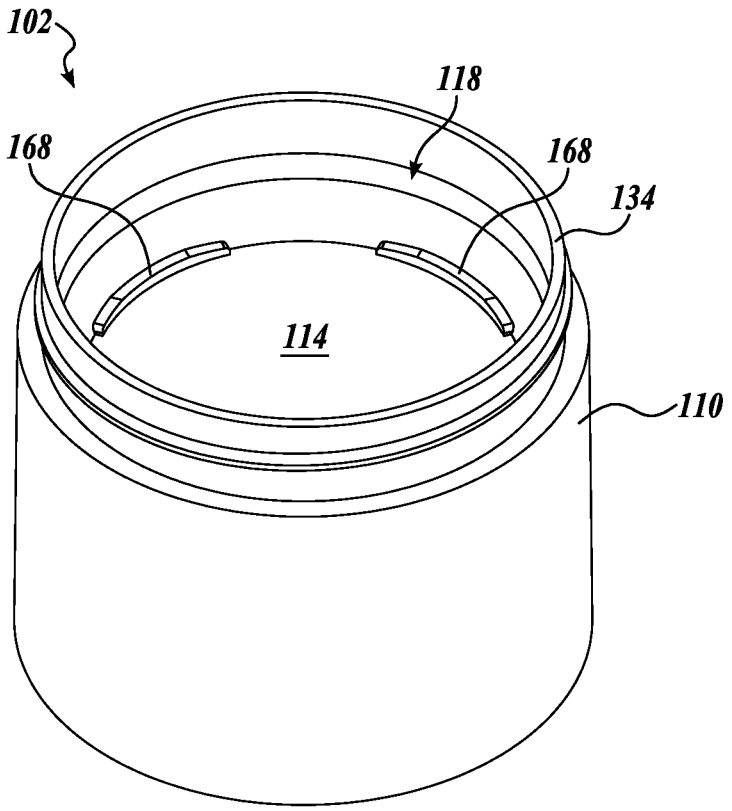
FIG. 5 is a top perspective view of the outer container of the representative refillable cosmetic system of FIG. 1.

As shown in FIGS. 2 and 4A-4B, the inner canister 104 may be defined as a jar or vessel having an inner cavity 148 for holding, for example, a cosmetic formula. The inner cavity 148 of the inner canister 104 is delimited by an outer wall 150, a bottom wall 154, and a top opening 156 proximate a top end 158 of the canister 104. When assembled, the inner canister 104 rests or is otherwise supported inside of the inner chamber 118 of the outer container 104.

In the embodiment shown, the inner canister 104 includes an outwardly projecting lip or flange 160 located at the top opening 156. The flange 160 engages and is supported by the stepped portion 134 of the container 104. The flange 160 aids in the placement and retention of the inner canister 104 when housed by the outer container 102. The flange 160 also provides a bearing surface that allows for rotation of the inner canister 104 with respect to the outer container 102 while maintaining longitudinal alignment thereof. In other words, the inner canister 104 is rotationally supported by the outer container 102 in some embodiments.

The inner canister 104 is shown as empty in FIGS. 2 and 4B, but the inner canister 104 may contain a cosmetic formula as described above or another material. In some embodiments, the cosmetic formula may be sealed in the inner canister 104 by way of a cover (not shown) such an aluminum, plastic, or other peelable or removable cover or lid.

As was briefly described above, the inner canister 104 interfaces with the outer container 102 in a selectively couplable manner. In that regard, the system 100 includes a coupling or locking system formed between the outer container 102 and the inner canister 104. In some embodiments, the coupling system is configured such that the inner canister 104 rotates with respect to the outer container 102 between a coupled or locked position that maintains attachment between the outer container 102 and the inner canister 104, and a decoupled or unlocated position that allows the inner canister 104 to be separated from the outer container 102.

In some embodiments, the coupling system may be formed by one or more first coupling features of the container 102 that selectively interact with one or more corresponding second coupling features on the exterior of the inner canister 104. In some embodiments, the coupling system may be formed as a lug-and-groove system, a slotted track and follower system, a latch and catch system, etc. For example, in the embodiment shown, the inner canister 104 includes one or more latches 166 formed thereon. The latches 166 extend outwardly away from the outer wall 150. The latches 166 interface with one or more catches 168 inwardly extending from an inner wall 170 of the outer container 102 when the inner canister 104 and outer container 102 are assembled. In an embodiment, the inner wall 170 is formed as a downward extension from the stepped portion 134.

In the depicted exemplary embodiment, the coupling or locking system is defined at least in part by a series of spaced apart catches 168 extending around and protrude inwardly from the inner wall 170. The spaced apart catches 168 may engage with a corresponding number of spaced apart latches 166 that extend around and protrude from the outer wall 150 of the inner canister 104. In an embodiment, the latches 166 slide beneath the catches 168 to prevent the inner canister 104 from moving upwardly relative to outer container.

As noted above, the latches and catches are also configured such that the inner canister 104 may be removed from the top opening 118 of the outer container 102 in a decoupled or unlocked position. In that regard, in the embodiment shown in FIG. 5, the catches 168 do not extend completely around the perimeter of the inner wall 170. Instead, the catches 168 are finite features interspaced and protruding from the inner wall 170. The latches 166 of the inner canister 104 are similarly arranged. This enables the latches 166 on the inner canister 104 to be moved passed and under the catches 168 when the inner canister 104 is inserted into the outer container and rotated into the locked position (i.e., the latches and catches are aligned). To remove the inner canister 104 in this embodiment, the inner canister 104 is rotated into the unlocked position (i.e., the latches and catches are not aligned but adjacent to one another).

The latches 166 and or catches 168 may be flexible. For example, the latches 166 and/or catches 168 may be flexible to provide a biasing force against each other to aid in retention of the inner canister 104 in a locked or coupled position. The quantity and placement both the latches 166 and catches 168 may vary in some embodiments. Of course, the catches 168 can be formed as grooves or slotted tracks for cooperatingly receiving the latches 166, or vice versa.

As discussed above, the flange 160 of the inner canister 104 engages and is supported by the stepped portion 134 of the outer container 104. The flange 106 aids in the placement and retention of the inner canister 104 when housed by the outer container 102. For example, when the flange 160 engages the stepped portion 134 adjacent the first opening 118, the inner canister 104 attains a predetermined longitudinal position inside the outer container 102. When in the predetermined longitudinal position, as shown in FIG. 2, the inner canister 104 is positioned such that the latches 166 and catches 168 interact in one or more interfacing techniques set forth above. Additionally, the flange 160 may prevent the bottom wall 154 of the canister 104 from extending beyond the second opening 124 of the outer container 102. In some embodiments, the flange 106 works in conjunction with the coupling system to lock the inner canister in place within the outer container 102.

Figure 3A:
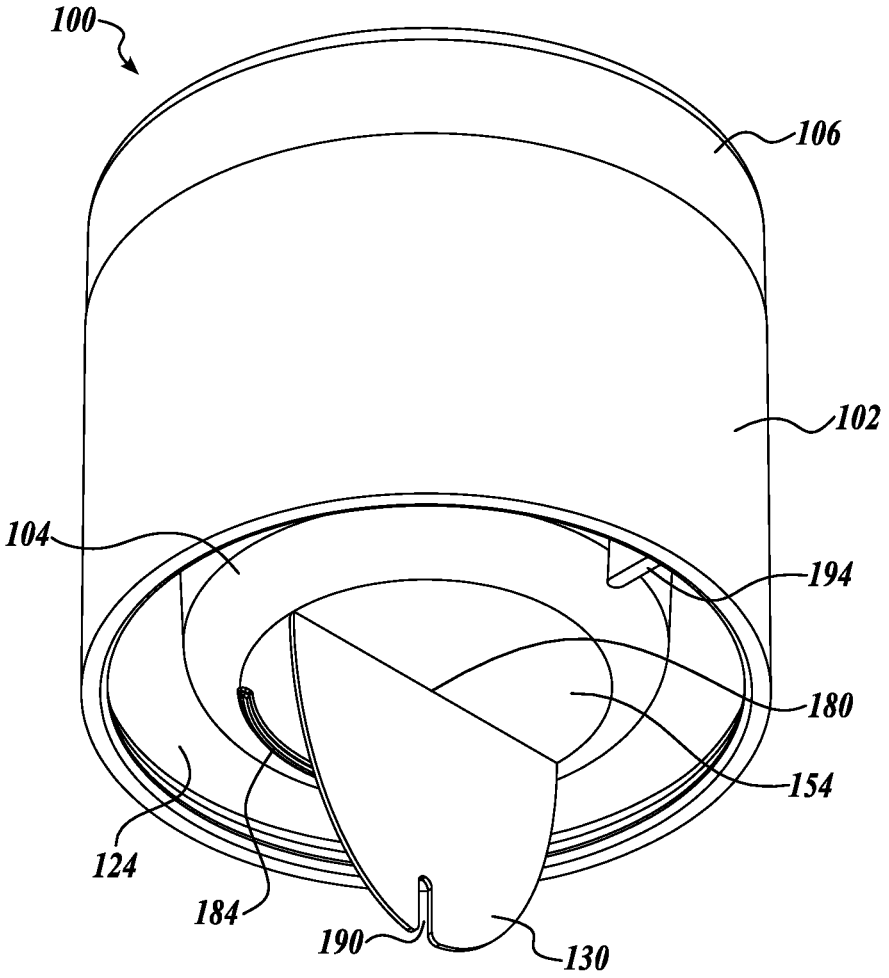
FIG. 3A is a bottom perspective view of the representative refillable cosmetic system of FIG. 2.
Figure 3B:
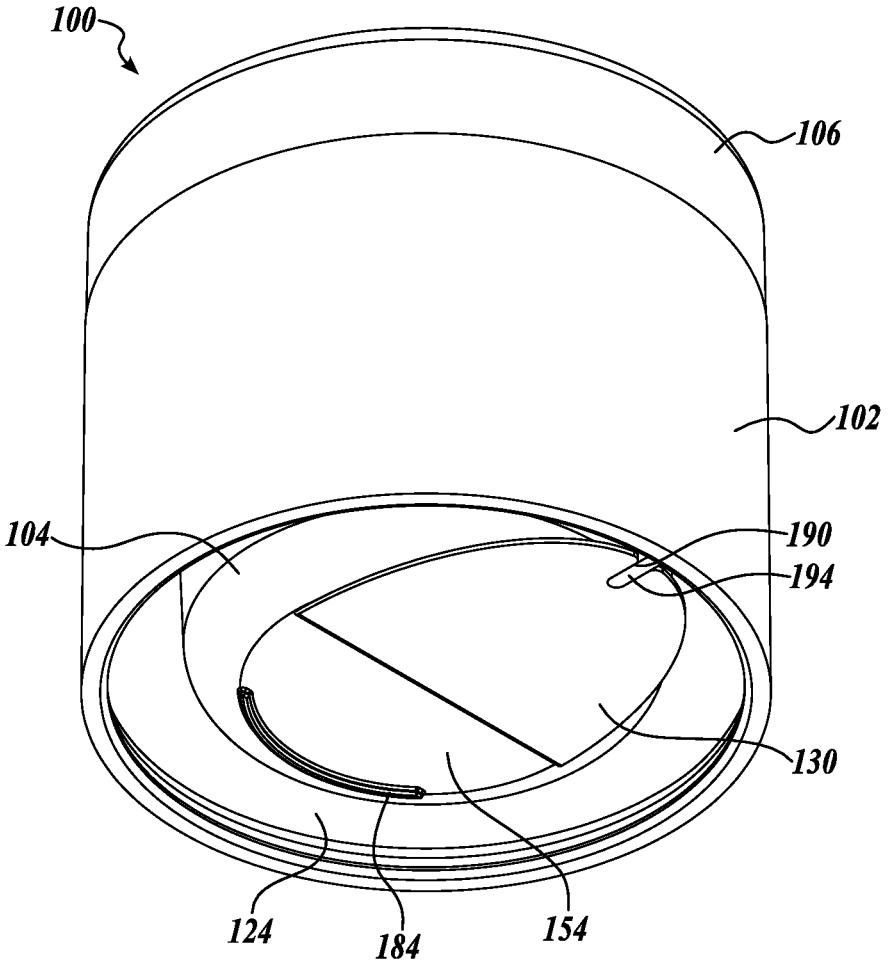
FIG. 3B is a bottom perspective view of the representative refillable cosmetic system of FIG. 2, depicting the handle in an extended position.

Turning now to FIGS. 3A and 3B, the handle 130 aids in rotating the inner canister 104 with respects to the outer container 102 between the coupled and decoupled positions. For example, the handle 130 permits improved or additional torque transfer from the user's hand to the inner canister 104. In an embodiment, the handle 130 is capable of protruding from the bottom end 174 of inner canister 104, and out of the bottom opening 124 of the outer container 102, as shown in FIG. 3A. In the depicted embodiment, the handle 130 is hingedly coupled to the bottom wall 154 of the inner canister 104, and is movable between a first or extended position of FIG. 3A and a second, retracted or stowed position of FIG. 3B.

In some embodiments, a hinge 180 may be formed between the handle 130 and bottom wall 154 via integrally formed hinge knuckles and a pin. In another embodiment, the hinge 180 may be separated formed, with cooperating parts coupled to the handle 130 and the inner canister 104, respectively. In use, the hinge 180 enables the handle 130 to extend perpendicularly away from the bottom wall 154 of the inner canister 104 so that the user can grip the handle 130 and apply a rotational force to twist or rotate the inner canister 104 into locking alignment with the outer container 102. The handle 130 may then be moved about the hinge 180 into the retracted or stowed position to provide a substantially flat surface proximate the bottom end 174 of the canister 104. To unlock the inner canister 104, the handle 130 is moved to its extended position, and a rotational force is applied to the handle to move the inner canister to the unlocked position. In the unlocked position, the inner canister 104 can be removed from the outer container 102.

In a certain embodiment, the handle 130 and inner canister 104 may be integrally formed so as to form a flexible or living hinge 180 therebetween. The living hinge 180 may reduce manufacturing costs and part counts and provide a lightweight component. In some embodiments, the living hinge 180 is formed with the use of plastic. For example, the living hinge 180 can be constructed with polypropylene, polypropylene/polymer blends, elastomers, silicones, urethanes or other suitably flexible materials. In some embodiments, the handle 130 is molded or manufactured in the extended position. After manufacture, the handle 130 is folded on the living hinge 180 against the bottom wall 154 of the inner canister 104 to attain the retracted or stowed position. It should be appreciated that the handle 130 may instead be movably secured to the inner canister 102 in any other suitable manner such that the handle 130 may fold, hinge, collapse, or otherwise be moved between the first and second positions.

When the handle 130 is folded into the second or stowed position, the handle 130 may provide a resting surface for the canister 104 to sit upon a surface. To properly balance the canister 104 on the surface, a support, such as leg 184, may be included on the bottom wall 154 opposite the handle 130 when folded (e.g., stowed). In the configuration shown, the leg 184 is a semi-circular ridge extending from the bottom wall 154. The leg 184 has substantially the same thickness as the handle 130 such that the canister 104 may rest upon a surface in a stable manner. It should be appreciated that the leg 184 could be of a variety of configurations and quantity to provide a substantially flat plane for the inner canister 104 to rest upon.

In accordance with another aspect of the present disclosure, the system 100 includes a locking feature associated with the handle. In use, with the handle 130 folded in the retracted position, the locking feature restricts removal of the inner canister 104 from the outer container 102 by, for example, prohibiting rotation of the inner canister 104 to the unlocked position.

In an embodiment, the locking features includes one (as shown) or more grooves or notches 190 disposed at the free end of the handle 130. The locking feature also includes one (as shown) or more ribs or protrusions 194 disposed on the interior of wall 110 of the outer container 102. In some embodiments, the handle 130 is not completely circular. Instead, when folded, the handle 130 extends beyond a perimeter of the bottom wall 154 of the outer canister 104, as shown in FIGS. 4A and 4B.

In the embodiment depicted in FIGS. 3A and 3B, when the outer container 102 and the inner canister 104 are in suitable alignment in the coupled or locked position, the handle 130 can be moved to the retracted position of FIG. 3B such that the protrusion 194 is aligned with and received by the notch 190 of the handle 130. Once received therein, the locking feature prevents the inner canister 104 from rotating with respect with the outer container 102. For example, the locking feature prevents the inner canister 104 from rotating to the unlocked position. As such, with the protrusion 194 received within the notch 190, and rotational movement between the outer container 102 and the inner canister 104 prevented, the locking feature ensures that the inner canister 104 does not prematurely or unnecessarily dislodge from the outer container 102.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A and B" is equivalent to "A and/or B" or vice versa, namely "A" alone, "B" alone or "A and B.". Similarly, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A refillable cosmetic container system, comprising:

an outer container with an outer wall defining an inner chamber with a first opening proximate a top of the outer container and a second opening proximate a bottom of the container;

an inner canister movably supported within the inner chamber of the outer container;

a handle hingedly coupled to the inner canister via a hinge, the handle positioned proximate a bottom end of the inner canister, the handle configured to pass through the second opening of the outer container, wherein the handle is configured to interface with the outer container in order to prevent relative movement between the inner canister and the outer container, and wherein the handle is moved about the hinge from a first position in which the handle extends outwardly from a bottom wall of the inner canister and a second position in which the handle is stowed adjacent the bottom wall of the inner canister and is detachably coupled to the outer container.

2. The refillable cosmetic container system of claim 1, wherein a torque applied to the handle locks the inner canister to the outer container.

3. The refillable cosmetic container system of claim 1, wherein the inner canister is rotationally supported by the outer container, and wherein a rotational force applied to the handle causes the inner canister to rotate with respect to the outer container.

4. The refillable cosmetic container system of claim 3, further comprising a lock formed between the inner canister and the outer container, wherein rotation of the inner canister with respect to the outer container via the rotational force applied to the handle allows for selective coupling of the inner canister to the outer container.

5. The refillable cosmetic container system of claim 1, wherein the hinge is a living hinge.

6. The refillable cosmetic container system of claim 1, wherein the outer container is reusable and the inner canister is replaceable.

7. The refillable cosmetic container system of claim 1, wherein the outer container is reusable.

8. The refillable cosmetic container system of claim 1, wherein the inner canister contains a cosmetic formula.

9. The refillable cosmetic container system of claim 1, further comprising:

a lid coupleable to the top of the outer container.

10. The refillable cosmetic container system of claim 1, further comprising a locking system, wherein the locking system comprises:

a first locking feature disposed on the handle; and a second locking feature disposed on the outer container and extending inwardly therefrom;

wherein the first locking feature engages the second locking feature in order to prevent relative movement between the inner canister and the outer container.

11. A refillable cosmetic container system, comprising:

an outer container with an outer wall defining an inner chamber with a first opening proximate a top of the outer container and a second opening proximate a bottom of the container;

an inner canister movably supported within the inner chamber of the outer container;

a handle hingedly coupled to the inner canister via a hinge, the handle positioned proximate a bottom end of the inner canister, the handle configured to pass through the second opening of the outer container; and a locking system comprising a first locking feature disposed on the handle and a second locking feature disposed on the outer container and extending inwardly therefrom;

wherein the first locking feature disposed on the handle engages with the second locking feature disposed on the outer container in order to prevent relative movement between the inner canister and the outer container, wherein the handle is moved about the hinge from a first position in which the handle extends outwardly from a bottom wall of the inner canister and a second position in which the handle is stowed adjacent the bottom wall of the inner canister and is detachably coupled to the outer container.

12. The refillable cosmetic container system of claim 11, wherein the inner canister is rotatably supported by the outer container, and wherein the locking system is configured to prevent rotational movement of the inner canister with respect to the outer container.

13. The refillable cosmetic container system of claim 12, wherein when the handle is in the first position, the inner canister is rotatably movable with respect to the outer container between a locked position, in which the inner canister is prevented from decoupling from the outer container, and an unlocked position, in which the inner canister is permitted to be removed from the outer container through the first opening of the outer container.

* * * * *